US006779309B2

(12) United States Patent
Sundolm

(10) Patent No.: US 6,779,309 B2
(45) Date of Patent: Aug. 24, 2004

(54) DOOR ACTUATOR FOR COOLING A FIRE DOOR

(75) Inventor: Göran Sundolm, Vantaa (FI)

(73) Assignee: Marioff Corporation Oy, Vantaa (FI)

( * ) Notice: Subject to any disclaimer, the term of this patent is extended or adjusted under 35 U.S.C. 154(b) by 0 days.

(21) Appl. No.: 10/204,164

(22) PCT Filed: Mar. 14, 2001

(86) PCT No.: PCT/FI01/00249

§ 371 (c)(1),
(2), (4) Date: Oct. 23, 2002

(87) PCT Pub. No.: WO01/69028

PCT Pub. Date: Sep. 20, 2001

(65) Prior Publication Data

US 2003/0115804 A1 Jun. 26, 2003

(30) Foreign Application Priority Data

Mar. 15, 2000 (FI) ..... 20000600

(51) Int. Cl.[7] ..... E06B 5/16
(52) U.S. Cl. ..... 49/360; 49/1; 49/360
(58) Field of Search ..... 49/1, 356, 360

(56) References Cited

U.S. PATENT DOCUMENTS 1,781,026 A * 11/1930 Mapes ..... 169/11
3,779,179 A * 12/1973 Marois ..... 109/33
3,802,123 A * 4/1974 Frey et al. ..... 49/141
3,964,125 A * 6/1976 Tansley ..... 16/48.5
4,075,798 A * 2/1978 Tazaki ..... 52/168
4,301,631 A * 11/1981 Tazaki ..... 52/168
4,347,901 A * 9/1982 Wilhoit ..... 169/62
4,433,985 A * 2/1984 McGee ..... 96/111
5,210,985 A * 5/1993 Hsu ..... 52/169.6
5,353,879 A * 10/1994 Watanabe et al. ..... 169/52
6,049,287 A * 4/2000 Yulkowski ..... 340/693.12
6,425,211 B1 * 7/2002 Wise et al. ..... 52/1
6,675,535 B2 * 1/2004 Armstrong et al. ..... 49/340

FOREIGN PATENT DOCUMENTS

| | | |
|---|---|---|
| EP | 0798441 | 10/1997 |
| FR | 2700186 | 7/1994 |
| GB | 1224385 | 3/1971 |

* cited by examiner

*Primary Examiner*—Gregory J. Strimbu
(74) *Attorney, Agent, or Firm*—Ladas & Parry

(57) ABSTRACT

A hydraulic fire door, especially a sliding door, which can be selectively opened or closed by an actuator. In order to ensure a particularly fire resistant fire door without the heat resistance of the basic structure thereof having to be particularly fire resistant, the actuator is arranged to supply aqueous liquid to the fire door in order to cool it using the aqueous liquid.

29 Claims, 4 Drawing Sheets

DOOR ACTUATOR FOR COOLING A FIRE DOOR

BACKGROUND OF THE INVENTION

The invention relates to a hydraulic fire door, especially a sliding door, which can be selectively opened or closed, the fire door being provided with an actuator for moving the door from an opened position to a closed position.

Hydraulic fire doors are known. They are generally, i.e. not in the event of fire, used together with door openings, which are kept open. When fire occurs or when flue gases are created, the fire doors are closed in order to prevent the fire or flue gases from spreading.

If a fire door needs to be highly resistant in high temperatures, the door is correspondingly dimensioned and made of a material or materials that endure high temperatures. Therefore the fire door surfaces are typically made of steel. Steel fire doors do not allow to monitor the fire and/or flue gases through the door. The people possibly behind the closed steel doors cannot either be seen. Transparency would, however, help to evaluate how far the fire and flue gases have spread, and also to observe the people, which naturally is of advantage in the event of fire. The massive weight of steel makes the steel doors heavy. Where applied, for example on ships, the massive weight of the fire doors is a significant drawback. Known fire doors are provided with hydraulic pipe system and control systems that render the hydraulic fire doors fairly expensive.

The invention also relates to a fire protection system comprising a fire extinguishing system and a hydraulic fire door, more particularly to a sliding door, which can be selectively opened or closed, the fire door being provided with an actuator for moving the door from an opened position to a closed position. The fire protection system typically comprises several spray heads and fire doors. These fire doors are also associated with the problems described above.

The fire doors including hydraulic systems are notably constructed as systems separate from fire extinguishing systems, so that a piston cylinder unit in the fire doors comprising feeding pipes and a control system are placed apart in a pipe system and a control system of the fire protection system, consequently rendering the fire protection system very expensive.

BRIEF DESCRIPTION OF THE INVENTION

It is an object of the invention to provide a hydraulic fire door having an improved fire resistance and irrespective thereof the fire door can if desired be made of a material whose fire resistance is not particularly good.

This is achieved with a fire door of the invention characterized in that the actuator is arranged to supply liquid. For said purpose the present invention provides for a hydraulic fire door, especially a sliding door, which can be selectively opened or closed, the fire door being provided with an actuator for moving the door from an opened position to a closed position, wherein the actuator is arranged to supply aqueous liquid to the fire door in order to cool it using the aqueous liquid. The liquid to be employed in the actuator is used to close the door. A facing surface of the door is preferably cooled; the term facing surface referring in this context to any large door surface. The facing surface may be an outer surface or an inner surface.

The most significant advantages of the fire door of the invention are that the fire resistance thereof is very good without the heat resistance of the basic structure thereof, i.e. the frame or face surfaces of the door, having to be particularly good, in which case the fire door may, for example, be transparent and made of glass, and that an actuator, such as a piston cylinder unit, is utilized for improving the fire resistance thereof in order to cool the door, whereby the fire door and the apparatus cooling the door are formed of a compact unit.

The fire protection system of the invention is characterized in that the actuator is arranged to supply aqueous liquid to the fire door in order to cool it using the aqueous liquid. Present invention provides for a fire protection system comprising a fire extinguishing system and a hydraulic fire door, especially a sliding door, which can be selectively opened or closed, the fire door being provided with an actuator for moving the fire door from an opened position to a closed position, wherein the actuator is arranged to feed aqueous liquid to the fire door in order to cool it using the aqueous liquid.

Most preferably the actuator is connected with a line in the fire extinguishing system for supplying said liquid through an output starting from the actuator and a feeding channel to the upper part of the fire door and from there further to the facing surface of the fire door. Thus the large surfaces of the doors can from the beginning be evenly cooled, as the cooling is most efficient there where the temperature most likely is the highest in the event of fire.

The line is preferably the one leading to the spray heads of a fire extinguishing or fire fighting system, since the lines intended for the spray heads are then utilized as well as the pressures therein when closing and cooling the door, and the door hydraulics is not different from the fire extinguishing hydraulics. This allows great cost savings to be made.

The actuator is preferably a piston cylinder unit comprising a piston and a cylinder, since the structure of such a unit is simple.

The most significant advantage of the fire protection system according to the invention is that in addition to the fire extinguishing system it comprises a fire door, whose fire resistance is very good without the heat resistance of the basic structure thereof, i.e. the frame or facing surfaces of the door, having to be particularly good, in which case the fire door may, for example, be made of glass, or be transparent, and that the actuator is utilized for improving the fire resistance of the fire door (for cooling the door), the fire door and the apparatus cooling the door thus forming a compact unit. As the actuator is also connected to a line leading to the spray heads in the fire extinguishing system, great cost savings are made, since the lines in the fire protection system are greatly reduced as well as the need for control.

BRIEF DESCRIPTION OF THE DRAWINGS

In the following the invention will be described in greater detail by means of the preferred embodiments with reference to the accompanying drawing, in which.

DETAILED DESCRIPTION OF THE INVENTION

Figure 1:
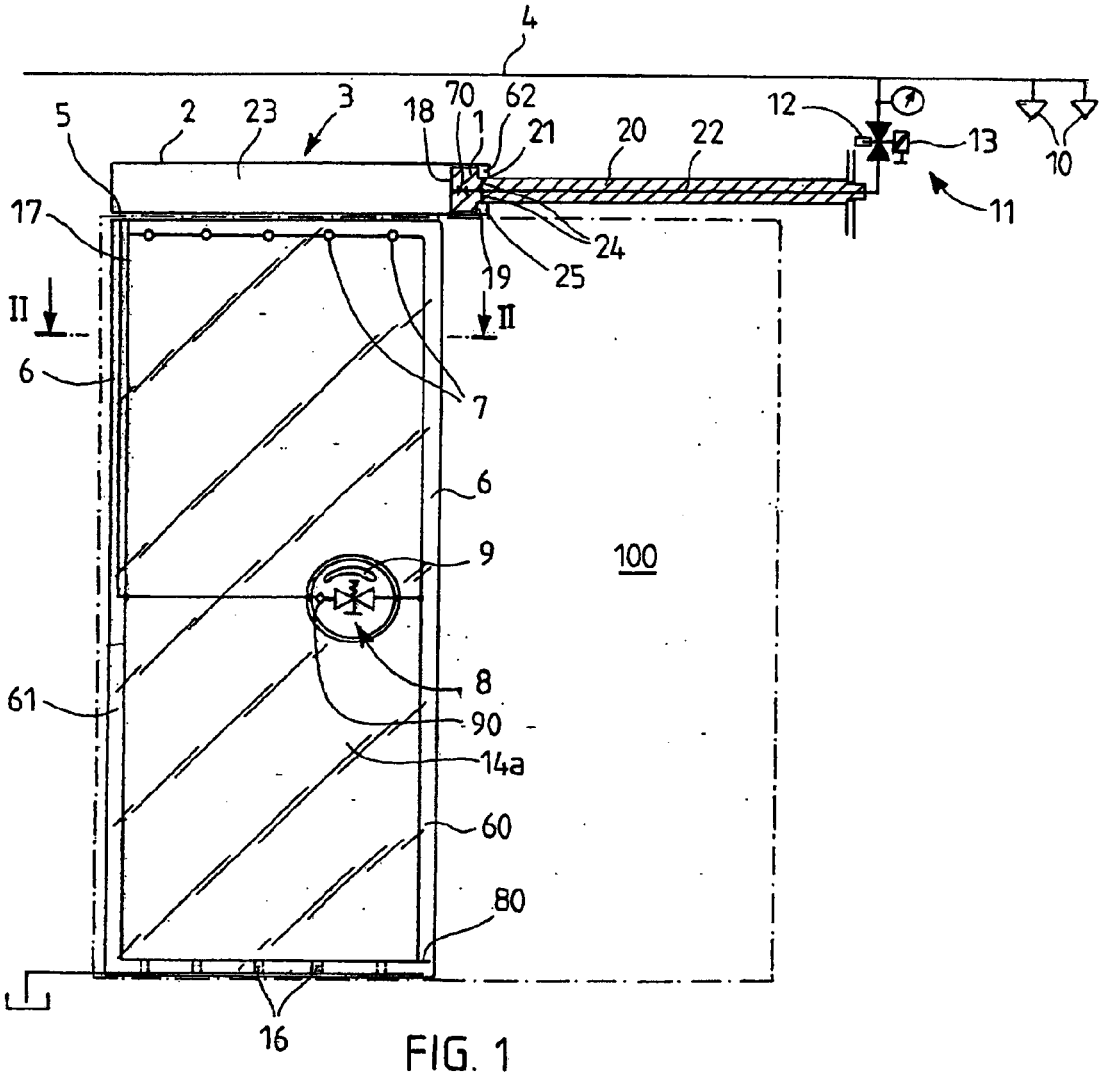
FIG. 1 shows a first embodiment of a fire door in an opened position.

FIG. 1 shows a fire door of the invention made of glass, and in an opened position, or in a standard using position. Reference numeral 100 illustrates a door opening. In the event of fire and/or when an attempt is made to prevent the access of flue gases through the door opening 100, said door opening is closed by means of the fire door.

The fire door is a sliding door. A piston cylinder unit 3 placed above the door enables the door to slide into the position shown in FIG. 3, in which the door covers the door opening.

The piston cylinder unit 3 is connected using a throttle valve 11 to a line 4 that leads to spray heads 10. The throttle valve 11 is generally closed.

The throttle valve 11 comprises a thermal trigger means 12 and a solenoid 13. The solenoid 13 is arranged to open the throttle valve 11 after obtaining a signal from the detector (not shown). The thermal trigger means may, for example, be a glass ampoule 12, which is arranged to open the throttle valve 11 after having exploded at a high temperature. The throttle valve 11 may also, or alternatively, be used mechanically.

The piston cylinder unit 3 comprises a cylinder 2 and a piston 1 arranged therein. Reference numeral 18 indicates a free end of the piston and reference numeral 19 another end of the piston, to which a piston rod 20 is attached. An opening 21 in a cylinder end 62 surrounds the piston rod 20 so that a liquid tight wall of the opening surrounds the piston rod. The piston rod 20 comprises a through passage 22 that continues through a throttling 70 to the free end 18 of the piston. The passage 22 provides a start for channels 24 leading to a space 25 defined by the piston end 19, the piston rod 20 and the end 62 at the cylinder 2 opening 21. The channel passing through the piston, the throttling 70 and the channels 24 are dimensioned such that the pressure created on the channel 22 (the pressure is formed when the throttle valve 11 opens) causes a higher pressure to the space 25 than to a space 23 defined by the cylinder 2 and the free end 19 of the piston. The flow resistance on the channels 24 is lower than the flow resistance through the piston 1 owing to the throttling 70. The structure may comprise only one channel instead of several channels.

The cylinder 2 includes an output 5 that leads to a feeding channel 6. The feeding channel 6 travels downwards from the output, first formed as a pipe, along a passage 61 on the vertical edge of the door. At a central or middle part of the door the pipe 6 continues horizontally past an actuating means 9 intended to open the door and through an opening valve 8 of the door to the opposite edge of the door, where the feeding channel is formed of a relatively narrow vertical passage 60. A door frame forms the passage 60. The passage 60 is restricted at the bottom against a stop 80 and continues upwards to the corner of the door and from there horizontally as a passage moving along the upper edge of the door with several spray openings 7 at the bottom thereof arranged substantially at the entire width of the door.

The opening valve 8 is generally open. The opening valve 8 is closed only in such a case, when the closed door is to be opened, cf. FIG. 3. The pipe 6 includes a check valve 90. The opening valve 8 can be closed using a handle 9 in the opening valve 8. The operation is mechanical and/or electric.

Figure 2:
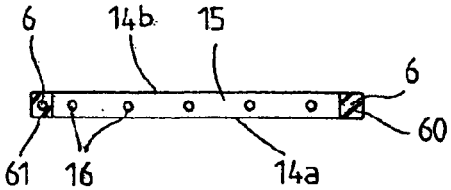
FIG. 2 shows a view along the cutting line II—II of FIG. 1.

FIG. 2 shows that the door comprises two spaced glass surfaces 14*a* and 14*b*, forming a so called double glazing, between which a space 15 is formed.

Figure 3:
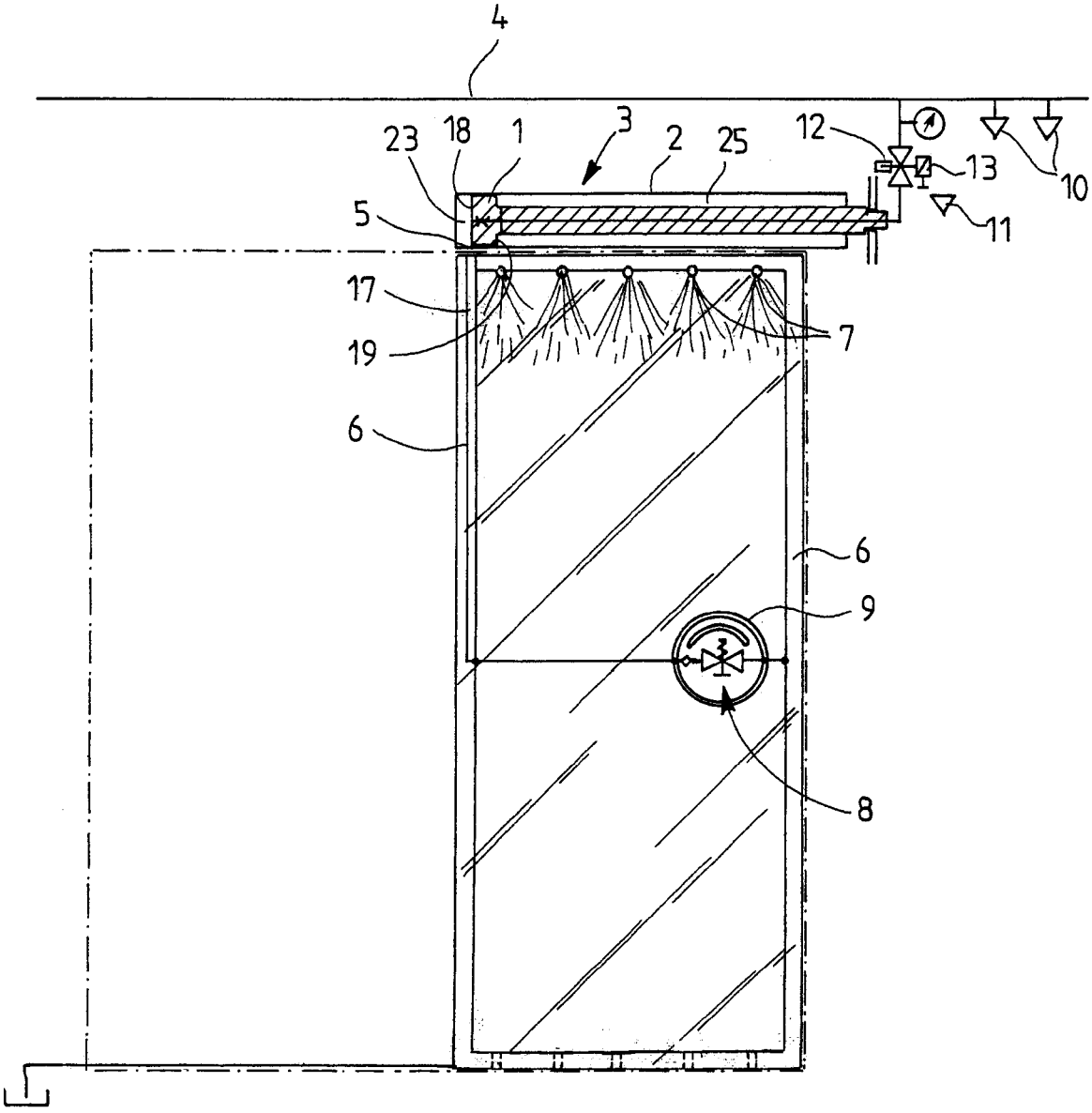
FIG. 3 shows the fire door of FIG. 1 in a closed position.

In the following the operation of the fire protection system in FIGS. 1 to 3 is explained.

When fire breaks out, the detector (not shown) that can be any detector reacting to fire, such as a smoke detector, provides a signal to the solenoid 13 of the throttle valve that opens the throttle valve 11. Alternatively an ampoule 12 attached to the throttle valve 11 opens the throttle valve after having exploded owing to the heat; thus providing an alternate means for opening the throttle valve. The compressed water in the line 4 moves through the throttle valve 11 to the piston cylinder unit 3 so that a higher pressure is formed to the space 25 than to the space 23. On account of the above the cylinder 2 moves in relation to the piston 1 and draws the door with it, as the door is fastened to the cylinder. When the cylinder 2 moves from the position shown in FIG. 1 to the right ending up in the position shown in FIG. 3, water flows to the space 23. Water flows through the output 5 to the pipe 6 and through the opening valve 8 to the passage 60 that is filled from the bottom to the top. The passage 60 rapidly fills up as the volume thereof is fairly small, manifoldly smaller than the volume of the space 15 between the glass surfaces 14*a*, 14*b*. The flowing water reaches the upper edge of the door and water starts to spray through the spray openings 7 onto the glass surfaces 14*a*, 14*b* cooling them evenly at least in the width direction of the door. The spray openings 7 are arranged to cool at first the upper part of the door, where the fire causes the highest heat stress to the door. A lower edge of the door comprises liquid outlet ports 16. The flow through the liquid outlet ports 16 is smaller than the flow from the spray openings 7. Therefore the space 15 is filled with water. The liquid outlet ports 16 provide the space 15 with an efficient, cooling water circulation. The liquid outlet ports 16 are naturally also intended to remove the water collected into the space 15 when the fire door is no longer subjected to an actual heat load. An overflow opening 17 is formed at the upper edge of the door that prevents an excess liquid pressure to be formed in the space 15. The water heated in the fire can also be removed through the overflow opening 17 from the upper part of the space 15 where the fire heats the water the most. The water flows along the passage 61 through the overflow opening 17 to the outlet port in the lower part of the door, and new cold and cooling water is constantly sprayed into the space 15 from the spray openings 7.

If the closed door in the position shown in FIG. 3 is to be opened, then a handle 9 is pulled and the opening valve 8 is shut and water can no longer flow inside the door and the door is opened. The door is opened since the pressure is normalized on both sides of the piston 1 of the piston cylinder unit 3, i.e. in the spaces 23 and 25. In the space 23, the surface of the piston's free end 18 that the pressure affects is greater than the surface of the piston end 19 that in the space 25 points towards the piston rod. When the door is closed, liquid flows out from the space 25.

Figure 4:
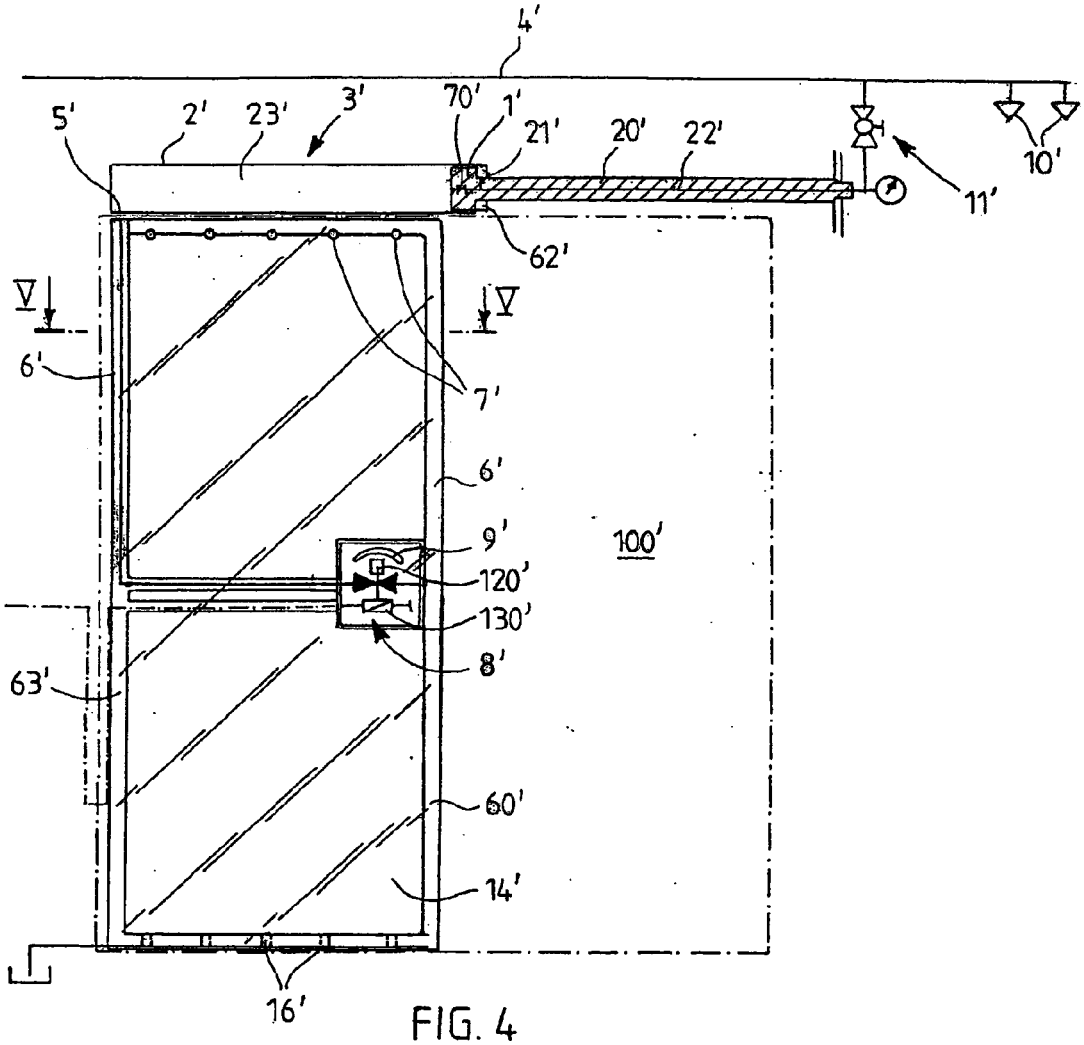
FIG. 4 shows a second embodiment of the fire door in an opened position.
Figure 5:
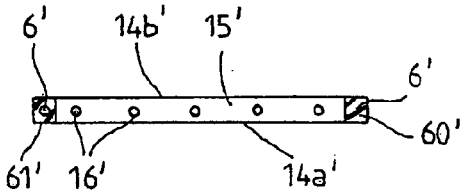
FIG. 5 shows a view along the cutting line V—V of FIG. 4.
Figure 6:
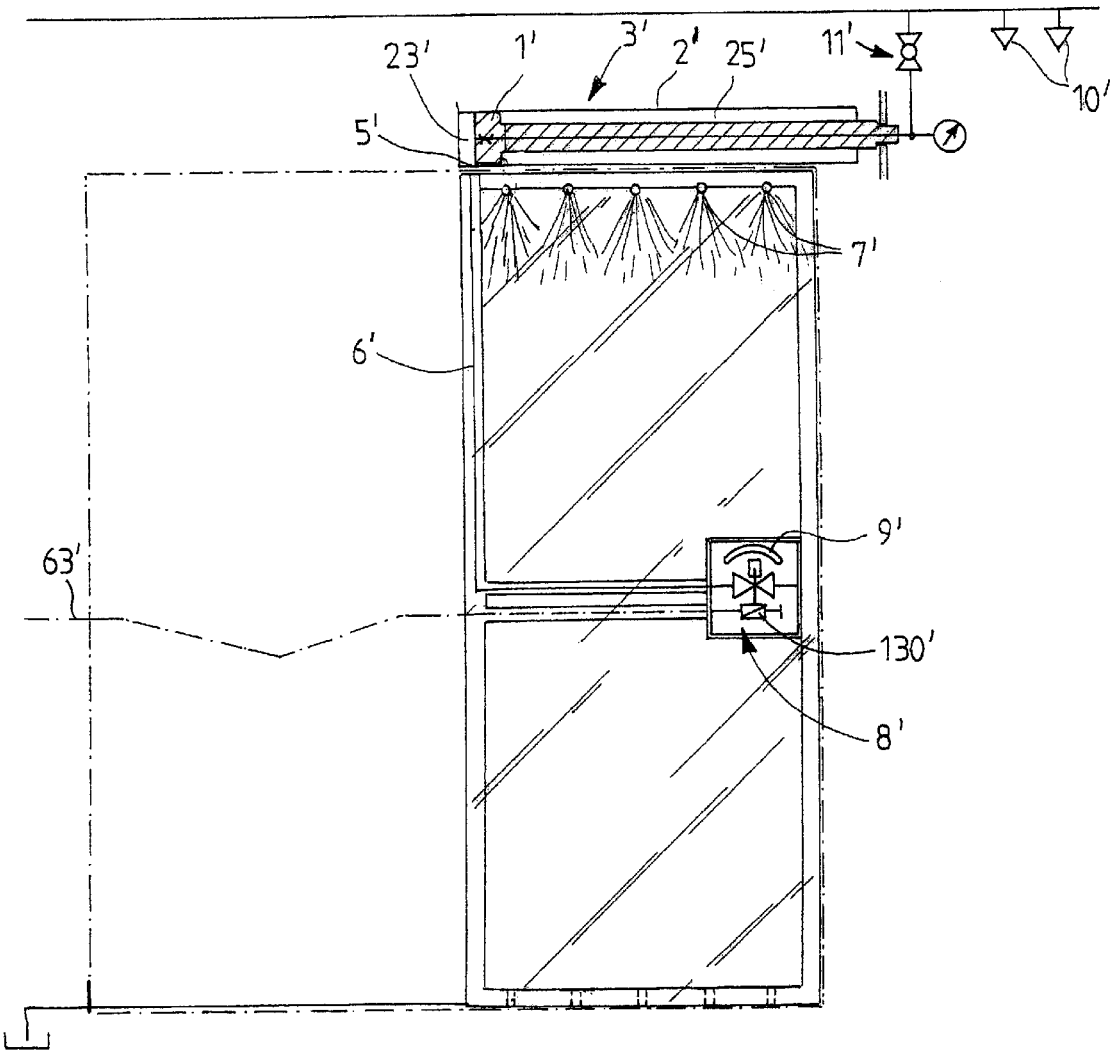
FIG. 6 shows the fire door of FIG. 4 in a closed position.

FIGS. 4 to 6 illustrate another embodiment of the invention. The same reference numerals are used in FIGS. 4 to 6 as in FIGS. 1 to 3 for corresponding parts.

The embodiment in FIGS. 4 to 6 deviates from the one shown in FIGS. 1 to 3 in that the ampoule 120' and solenoid 130' are arranged close to the opening valve 8'. The throttle valve is merely a mechanical closing valve 11' without an ampoule or a solenoid. The throttle valve 11' is generally open and the spray heads 10' are then typically sprinklers comprising ampoules reacting to heat.

The detector (not shown), which may be any detector reacting to fire, such as a smoke detector, provides through an electric wire 63' the solenoid 130' that opens the opening valve 8' with a signal in the event of fire. Then, as the door is opened and is in the position shown in FIG. 4, the cylinder 2' moves to the right and the door moves towards the position in FIG. 6. Alternatively the ampoule 120' connected to the opening valve 8' opens the opening valve, after been broken in the heat created by the fire. It is further possible that the ampoule 120' can also, or alternatively, be broken by heating using electric current. When the opening valve 8' is opened, water flows into the space 23' that is transferred via the output 5' and the pipe 6' through the opening valve to the passage 60'. When the passage 60' is filled with water, which occurs rapidly, the water starts to spray into the space 15' from the spray openings 7' and to flow away through outlets 16'.

If the fire door is to be opened from the position shown in FIG. 6, the opening valve 8' is closed, for example, by providing it with an electric impulse through the handle 9', in which case a mechanical electric opening is concerned. Alternatively the electric impulse can be achieved without the handle 9 or another mechanical device using a detector. The door is opened when the opening valve 8' is closed, and the liquid flows away from the space 25'.

The invention is described above by means of two examples and it is therefore pointed out that the details of the invention can be implemented in different ways deviating from the examples within the scope of the appended claims. Therefore, the door may for example include a single glass instead of double glazing 14*a*, 14*b*, 14*a*', 14*b*' or may include multi glazing. In a single glass door, the spray means 7, 7' are arranged to spray to either of the two outer surfaces of the glass or to both outer surfaces. The door does not necessarily have to be a glass door, although this is to be recommended. Instead of a piston cylinder unit another hydraulic actuator can be used that allows the door to be opened and closed and vice versa. However, the piston cylinder unit is an easy way to implement the actuator. Instead of a sliding door the fire door may, at least in principle, be e.g. a hinged door, in which case the actuator, typically a piston cylinder unit, is pivoted to the door. However, a sliding door is in many respects a better solution as a fire door than a hinged door. It is possible to initiate the closing of the door and the spraying of the liquid into the door manually without having to start these functions by means of a detector or an ampoule.

What is claimed is:

1. A hydraulic fire door which can be selectively opened or closed, the fire door being provided with an actuator (3, 3') for moving the door between an opened position and a closed position, wherein the actuator (3, 3') is arranged to supply aqueous liquid to the fire door in order to cool the fire door using the aqueous liquid.

2. A fire door as claimed in claim 1, wherein the actuator is arranged to supply said aqueous liquid onto a facing surface of the fire door.

3. A fire door as claimed in claim 1, wherein the actuator (3, 3') is arranged to supply said liquid through a feeding channel (6, 6') to an upper part of the fire door.

4. A fire door as claimed in claim 3, wherein the feeding channel (6, 6') comprises a set of spray openings (7, 7') arranged at the upper part of the fire door for supplying said liquid onto a facing surface of the fire door.

5. A fire door as claimed in claim 3, wherein the feeding channel (6, 6') comprises an opening valve (8, 8') for opening the fire door when the fire door is in the closed position.

6. A fire door as claimed in claim 5, wherein the opening valve (8, 8') is functionally connected to an actuating means (9, 9') arranged for closing the opening valve for opening the closed fire door.

7. A fire door as claimed in claim 6, wherein the actuating means is a mechanical device (9) arranged on the door.

8. A fire door as claimed in claim 6, wherein the actuating means comprises an at least partly electrical device (9').

9. A fire door as claimed in claim 6, wherein the opening valve (8') comprises a solenoid (130') for opening the opening valve and for closing the fire door from the opened position.

10. A fire door as claimed in claim 6, wherein the opening valve (8') comprises a thermal trigger means (120') for opening the opening valve and for closing the opened fire door.

11. A fire door as claimed in claim 1, wherein the actuator (3, 3') is connected to a line (4, 4') leading to spray heads (10, 10') in a fire extinguishing system.

12. A fire door as claimed in claim 11, wherein a throttle valve (11, 11') is arranged between the line (4, 4') and the actuator (3, 3').

13. A fire door as claimed in claim 12, wherein the throttle valve (11) comprises a solenoid (13) for closing the throttle valve and for opening the fire door from the closed position.

14. A fire door as claimed in claim 12, wherein the throttle valve (11) comprises a thermal trigger means (12) for closing the opened fire door.

15. A fire door as claimed in claim 1, wherein the fire door is made of glass.

16. A fire door as claimed in claim 15, wherein the fire door comprises spaced glass surfaces (14*a*, 14*b*, 14*a*', 14*b*') and a feeding channel (6, 6') is arranged to supply said liquid into a space (15, 15') between the surfaces.

17. A fire door as claimed in claim 16, wherein the fire door comprises a passage (60, 60'), the passage being a part of said feeding channel (6, 6').

18. A fire door as claimed in claim 17, wherein the passage (60, 60') is formed inside a frame of the door.

19. A fire door as claimed in claim 17, wherein a lower part of the fire door comprises at least one liquid outlet opening (16, 16').

20. A fire door as claimed in claim 19, wherein an upper part of the fire door comprises an overflow opening (17) for emptying the liquid into the lower part of the fire door.

21. A fire door as claimed in claim 1, wherein the actuator is a piston cylinder unit (3, 3') comprising a piston (1, 1') and a cylinder (2, 2').

22. A fire door as claimed in claim 21, wherein the piston (1, 1') of the piston cylinder unit (3, 3') comprises a free end (18, 18') and an opposite end (19, 19') arranged opposite to the free end, said opposite end (19, 19') being connected to a piston rod (20, 20') that is surrounded by an opening (21, 21') in the cylinder, and the piston rod and the piston comprise a through passage (22, 24, 22', 24') for supplying said liquid into a first space (23, 23') between the cylinder and the free end of the piston and a second space (25, 25') defined by the piston rod, the opposite end of the piston and the cylinder.

23. A fire door as claimed in claim 22, wherein a flow resistance of the passage (22, 24, 22', 24') leading to the first space (23, 23') exceeds a flow resistance of the passage leading to the second space (25, 25').

24. A fire door as claimed in claim 1, wherein the fire door is a sliding door.

25. A fire protection system comprising a fire extinguishing system and a hydraulic fire door which can be selectively opened or closed, the fire door being provided with an actuator (3, 3') for moving the fire door between an opened position and a closed position, wherein the actuator (3, 3') is arranged to feed aqueous liquid to the fire door in order to cool the fire door using the aqueous liquid.

26. A fire protection system as claimed in claim 25, wherein the actuator is arranged to supply said aqueous liquid onto a facing surface of the fire door.

27. A fire protection system as claimed in claim 26, wherein the actuator is a piston cylinder unit (3, 3') comprising a piston (1, 1') and a cylinder (2, 2').

28. A fire protection system as claimed in claim 25, wherein the actuator (3, 3') is connected to a line (4, 4') of a fire extinguishing system for feeding said liquid through an output (5, 5') of the actuator (3, 3') to a feeding channel (6, 6') of the fire door.

29. A fire protection system as claimed in claim 28, wherein the line is a feeding line (4, 4') leading to spray heads (10, 10') in the fire extinguishing system.

* * * * *